US007299558B2

(12) United States Patent
Wang

(10) Patent No.: US 7,299,558 B2
(45) Date of Patent: Nov. 27, 2007

(54) LINE MARKER

(75) Inventor: Bilei Wang, Shanghai (CN)

(73) Assignee: Leiyu (Shanghai) Packaging Products Co., Ltd., Xujing Town, Qingpu District, Shanghai (CN)

( * ) Notice: Subject to any disclaimer, the term of this patent is extended or adjusted under 35 U.S.C. 154(b) by 0 days.

(21) Appl. No.: 11/437,080

(22) Filed: May 19, 2006

(65) Prior Publication Data

US 2006/0260145 A1 Nov. 23, 2006

(30) Foreign Application Priority Data

| | | |
|---|---|---|
| May 20, 2005 | (CN) | 2005 1 0026014 |
| May 20, 2005 | (CN) | 2005 2 0041704 U |
| May 20, 2005 | (CN) | 2005 2 0041705 U |
| Jul. 27, 2005 | (CN) | 2005 2 0043806 U |
| Nov. 28, 2005 | (CN) | 2005 2 0046979 U |

(51) Int. Cl.
*B43L 7/00* (2006.01)

(52) U.S. Cl. ..... 33/414; 33/413

(58) Field of Classification Search ..... 33/413–414
See application file for complete search history.

(56) References Cited

U.S. PATENT DOCUMENTS

| | | | | |
|---|---|---|---|---|
| 4,551,847 | A * | 11/1985 | Caldwell | 33/755 |
| 5,704,131 | A * | 1/1998 | Courtney | 33/394 |
| 6,393,709 | B1 * | 5/2002 | Jones | 33/414 |
| 6,931,742 | B1 * | 8/2005 | VanWinkle | 33/414 |

* cited by examiner

*Primary Examiner*—Yartiza Guadalupe-McCall
(74) *Attorney, Agent, or Firm*—Raymond Y. Chan; David and Raymond Patent Group

(57) ABSTRACT

A line marker includes a housing having a receiving cavity and an opening communicating with the receiving cavity, a retracting unit supported within the receiving cavity of the housing, an operating cable having an inner coupling end coupling with the retracting unit and an outer control end extending out of the receiving cavity through the opening, and an indicating element container supported in the housing, wherein the indicating element container includes an absorbing element disposed therein to absorb the indicating element, wherein the operating portion of the operating cable contacts with the absorbing element to evenly apply the indicating element along the operating cable when the operating cable is pulled out from the housing for marking a straight line on a surface.

11 Claims, 11 Drawing Sheets

LINE MARKER

BACKGROUND OF THE PRESENT INVENTION

1. Field of Invention

The present invention relates to marking tool, and more particularly to a line marker which is very user friendly and convenient with multi-functions as compared to related conventional arts.

2. Description of Related Arts

A conventional line marking tools generally comprises a housing having a containing cavity, an elongated wire received in the housing, and an indicating element such as ink or chalk is contained in the containing cavity, wherein when the wire pulled out from the housing, an indicating element is applied along the wire for marking a straight line on a surface. However, such conventional line marking tools have many disadvantages. Indicating element such as ink or chalk is usually added directly inside the containing cavity and it is often to see spilling of ink when excessive amount of ink is added. It will pollute the working environment and affect the accuracy of the line marking tool. Another disadvantage of the conventional art is that the indicating element usually contained in an indicating element container such as an ink box is very inconvenient to use. These conventional ink boxes lack a cover to contain the content so that it is easy to spill and cause troubles for transportation. In addition, the ink box usually has a cotton foam element to absorb and apply the ink on the wire. It is required by the user to use their fingers to exert pressure on the cotton foam element so that the ink can coat on the wire. This method will make the user's hand dirty. Also, conventional line marking tool requires the user to reel in the wire manually which is very inconvenient and unsafe. The conventional line marking tool also has a problem with stabilizing the main body itself onto one place for functioning. Users often have to apply a great amount of strength to control and thus causing accidents. Finally, a pinhead for stabilizing from the conventional line marking in place is usually not retractable and is exposed to the exterior thus increasing the chance of accidents.

SUMMARY OF THE PRESENT INVENTION

A main object of the present invention is to provide a line marker, wherein an indicating element such as ink or chalk can be directly coated on an operating cable from a retracting unit when reeling the operating cable for line marking so as to enhance the operation of the line marker with hand-free manner.

Another object of the present invention is to provide a line marker, wherein an indicating element container box for containing an indicating element such as ink or chalk can be conveniently replaced. In other words, the indicating element container box is replaceably received in the housing such that the user is able to replace the used container box when the indicating element is used up.

Another object of the present invention is to provide a line marker, wherein an indicating element box is enclosed so as to completely contain an indicating element such as ink or chalk to avoid spilling to the exterior.

Another object of the present invention is to provide a line marker, wherein an indicating element can easily coated on an operating cable without the user directly touching the indicating element, so as to keep the hand of the user clean.

In other words, the user does not need to apply any force at the operating cable in order to apply the indicating element along the operating cable during operation.

Another object of the present invention is to provide a line marker, wherein the operating cable can be retracted automatically by a retracting unit after marking a line so as to provide a hand-free retractable operation of the operation cable.

Another object of the present invention is to provide a line marker, wherein the operating cable can be retracted automatically via a motor driven by a power source such as solar power or battery so as to reduce the risk of accidents when retracting the operating cable. In addition, no battery is required when solar power is collected to recharge the rechargeable battery.

Another object of the present invention is to provide a line marker, wherein a pinhead for stabilizing the line marker in place is retractable and can be retracted inside the line marker when not in use. In other words, the pinhead is received in the housing when it is not in use so as to provide a safety feature of the line marker.

Accordingly, in order to accomplish the above objects, the present invention provides a line marker comprising:

a housing having a receiving cavity and an opening communicating with the receiving cavity;

a retracting unit supported within the receiving cavity of the housing;

an operating cable having an inner coupling end coupling with the retracting unit and an outer control end extending out of the receiving cavity through the opening, wherein the retracting unit normally retracts the operating cable in the receiving cavity in a coil manner; and an indicating element contained in the receiving cavity at a position that when an operating portion of the operating cable is pulled out from the receiving cavity through the opening, the indicating element is applied along the operating portion of the operating cable for marking a straight line on a surface.

Referring to the first embodiment of the present invention, the retracting unit further comprises an indicating element container having an indicating element cavity for containing the indicating element, such as ink or chalk, therein, and an operation cavity communicating with the indicating element cavity. Preferably, the indicating element is liquid ink to apply along the operating cable. The indicating element container comprises a sealing member, such as rubber piece, sealedly disposed in the indicating element cavity to seal the indicating element therein, and an absorbing receptor disposed in the operation cavity to absorb the indicating element released from the indicating element cavity, wherein when the operating cable is pulled out from the housing, the operating portion of the operating cable contacts with the absorbing receptor to apply the indicating element along the operating portion of the operating cable.

Referring to another embodiment of the present invention, the housing further has a container cavity replaceably receiving an indicating element container therein, and an operating pusher movably mounted on the housing to communicate with the container cavity, wherein when the operating cable is pulled out from the housing, the operating pusher is pressed to drive the operating portion of the operating cable to contact with the indicating element container so as to apply the indicating element along the operating portion of the operating cable.

Referring to another embodiment of the present invention, the line marker further comprises an automatic retraction control coupling with the retracting unit to automatically retract the operating cable back in the housing, wherein automatic retraction control comprises a motor received in the housing, a gear unit coupling the motor with the retracting unit, and an operation button arranged to actuate the motor to drive the retracting unit to automatically retract the operating cable back in the housing.

Referring to another embodiment of the present invention, the line marker further comprises a position stabilizer having a pinhead slidably received in the housing, a pusher head movably mounted on the housing to push the pinhead of the position stabilizer out of the housing, and a pin locker supported in the housing to releasably lock up the position stabilizer when the pinhead thereof is pushed out of the housing. Therefore, the line marker of the present invention allows one-man operation that the housing is adapted to mount on the surface in place when the operating cable is pulled out of the housing.

a position stabilizer, a needle bar, a needle container, a control, a needle head, a anchor, the needle container is installed on top of the retracting unit, the needle bar is installed inside the needle container, the needle head is connected at one end of the needle bar, the position stabilizer is located on the left end of the retracting unit, the controller is located on the bottom end of the retracting unit, the anchor is installed on the outer control end of the operating cable wherein the operating cable is routed to go through the controller.

an indicating element container, a motor, a motor controller, a solar power electrical circuit board, a battery, and a tester, the motor is installed inside the cavity of the housing, the motor further comprises a gear on the output end, the gear couples with a cavity of the retracting unit, one end of the battery is connected to the motor controller and to an end of a main switch, a capacitor is connected to another end of the main switch, the tester is connected to one end of the capacitor, the motor controller is connected to another end of the tester, and finally one end of the motor is connected with another end of the motor controller, the outer control end further comprises a needle so that the operating cable can be fixed at one place.

the retracting unit further comprises a spring element, an operating wheel is installed on the central axis of the retracting unit, a turning plate is attached to the front end of the operating wheel, an operating rod is installed on the front end of the turning plate, the rear end of the turning plate has an operating key, an indicating element container is installed within the cavity of the housing to the right side of the retracting unit, a pin hole is installed at the right side of the cavity of the housing, a needle constrainer is connected to the end of the outer control end, the needle constrainer further comprises a needle housing, a needle, a spring, and a turning element, the indicating element container is sealed and empty within, a indicating element pressurize unit is installed at the rear end of the indicating element container.

Referring to another embodiment of the present invention, the line marker further comprises a position stabilizer, a needle bar, a needle container, a control, a needle head, a anchor, the needle container is installed on top of the retracting unit, the needle bar is installed inside the needle container, the needle head is connected at one end of the needle bar, the position stabilizer is located on the left end of the retracting unit, the controller is located on the bottom end of the retracting unit, the anchor is installed on the outer control end of the operating cable wherein the operating cable is routed to go through the controller.

These and other objectives, features, and advantages of the present invention will become apparent from the following detailed description, the accompanying drawings, and the appended claims.

DETAILED DESCRIPTION OF THE PREFERRED EMBODIMENT

Figure 1:
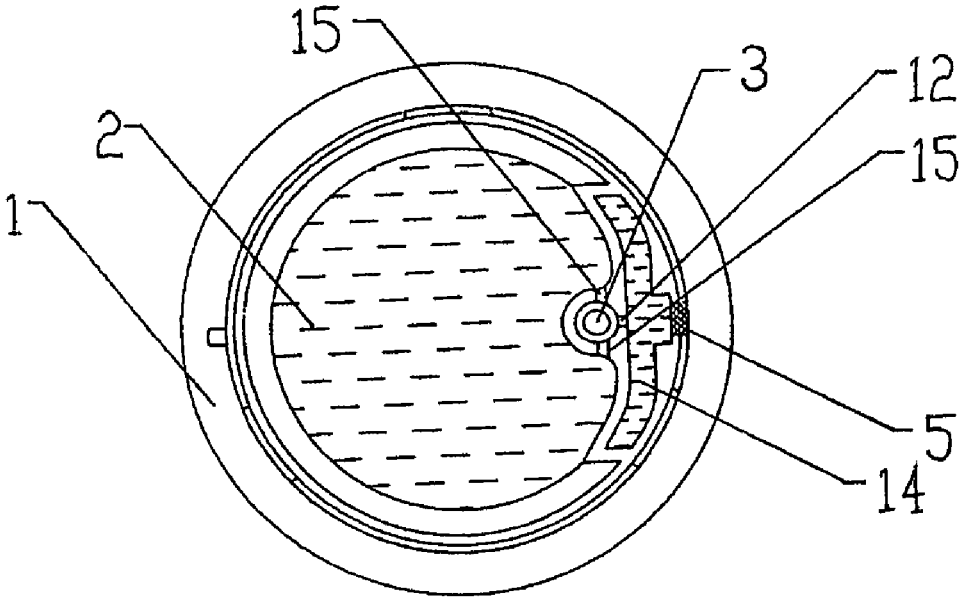
FIG. 1 is a side sectional view of a line marker according to a first preferred embodiment of the present invention.
Figure 2:
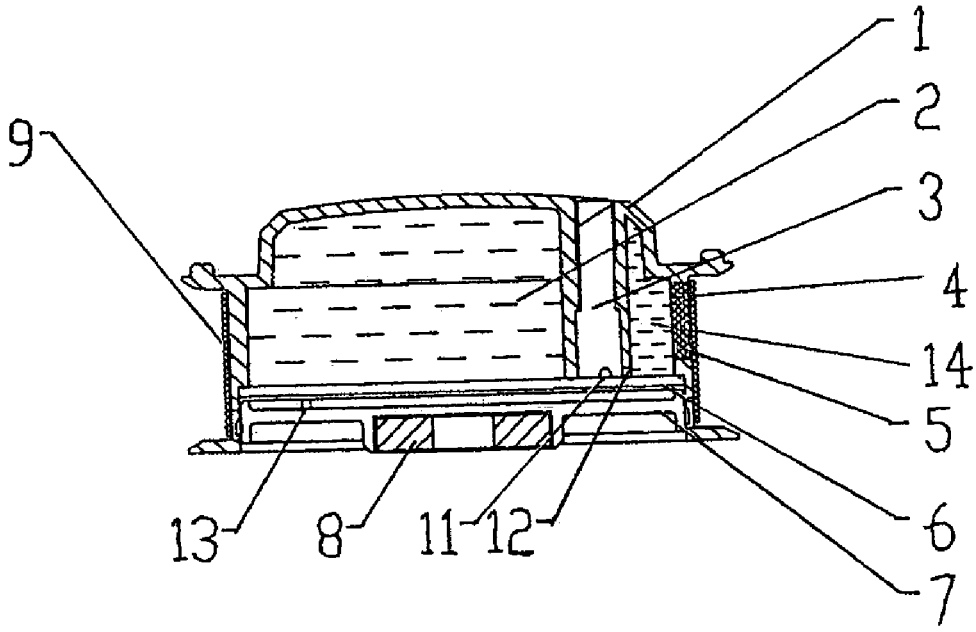
FIG. 2 is top sectional view of the line marker according to the above first preferred embodiment of the present invention.
Figure 3:
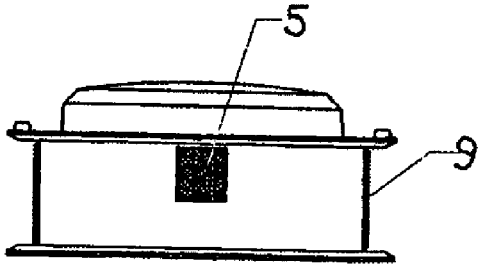
FIG. 3 is a side view of the line marker according to the above first preferred embodiment of the present invention, illustrating the foaming element at the reel.
Figure 4:
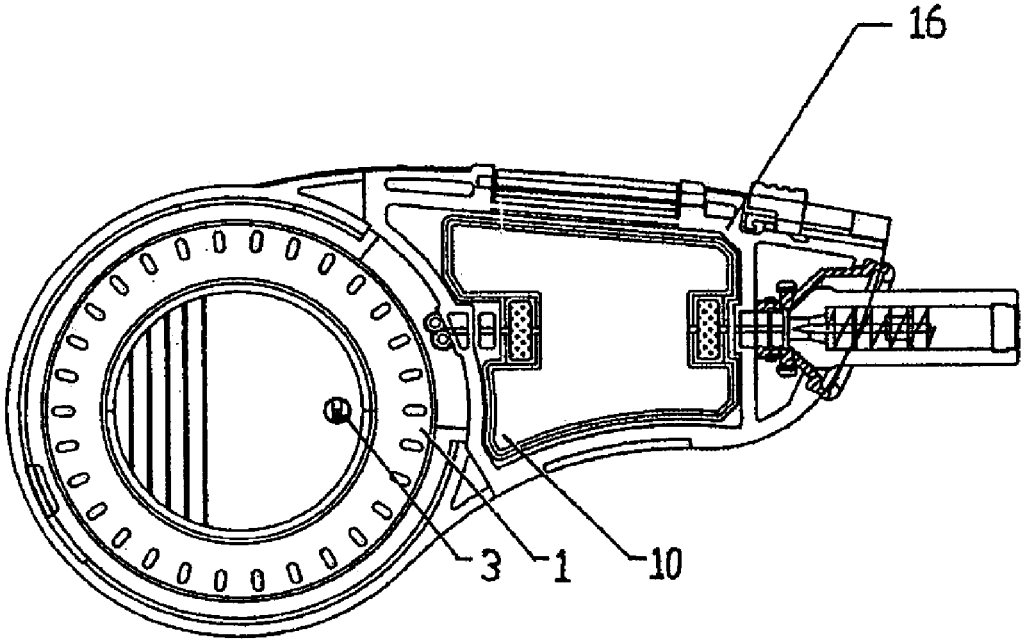
FIG. 4 is a partially sectional view of the line marker according to the above first preferred embodiment of the present invention.
Figure 5:
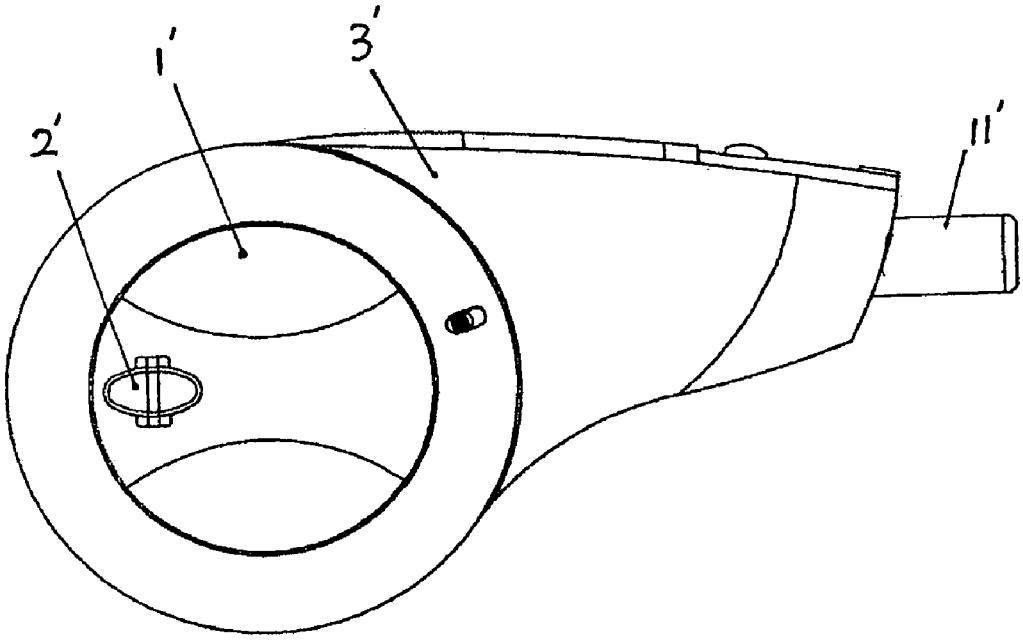
FIG. 5 is a first side view of a line marker according to a second preferred embodiment of the present invention.

Referring to FIG. 1 of the drawings, a line marker according to a first preferred embodiment of the present invention is illustrated. The line marker comprises a housing having a receiving cavity and an opening communicating with the receiving cavity, a retracting unit 3 supported within the receiving cavity of the housing, an operating cable 9 having an inner coupling end coupling with the retracting unit 3 and an outer control end extending out of the receiving cavity through the opening. A reel 1 is mounted within the housing to couple with the retracting unit 3, wherein the coupling end of the operating cable 9 is coupled with the reel 1 such that when the reel 1 is driven to rotate by the retracting unit 3, the operating cable 9 is retracted into the housing and is wound around the reel 1 in a coil manner. Accordingly, the retracting unit 3 normally retracts the operating cable 1 in the receiving cavity in a coil manner. The line marker further comprises an indicating element contained in the receiving cavity at a position that when an operating portion of the operating cable 9 is pulled out from the receiving cavity through the opening, the indicating element is applied along the operating portion of the operating cable 9 for marking a straight line on a surface. Accordingly, the housing further comprises a reel cover 7 detachably mounted to the housing to cover the reel 1, and a driving wheel 8 rotatably mounted to the housing to control the retracting unit 3 so as to drive the reel 1 to rotate to retract the operating cable 9. Accordingly, the retracting unit 3 comprises a hand-reel outwardly extended from the housing to manually turn the reel 1 to retract the operating cable 9.

According to the first preferred embodiment, the retracting unit 3 further comprises an indicating element container 10 having an indicating element cavity 2 for containing the indicating element, such as ink or chalk, therein, and an operation cavity 14 communicating with the indicating element cavity 2. The indicating element container 10 comprises a sealing member 6, such as rubber piece, sealedly disposed in the indicating element cavity 2 to seal the indicating element therein, and an absorbing receptor 4 disposed in the operation cavity 14 to absorb the indicating element released from the indicating element cavity 2, wherein when the operating cable 9 is pulled out from the housing, the operating portion of the operating cable 9 contacts with the absorbing receptor 4 to apply the indicating element along the operating portion of the operating cable 9. In addition, the reel cover 7 has a pressuring relief valve 13 for releasing the interior pressure of indicating element cavity 2 to outside.

Accordingly, the sealing member 6 self-adjustably balances an exterior pressure of the indicating element cavity 2 and an interior pressure thereof, wherein when the exterior pressure is larger than the interior pressure thereof, the indicating element in the indicating element cavity 2 is forced to fill into the operation cavity 14 and is adsorbed by the absorbing receptor 4. In other words, the indicating element will stop filling into the operation cavity 14 when the exterior pressure equals to the interior pressure. Therefore, such structural configuration of the indicating element container 10 prevents the indicating element from leaking accidentally. Accordingly, the indicating element cavity 2 and the operation cavity 14 are two individual compartments. There is at least a communicating hole 15 (preferably two) communicatively formed on a wall of the indicating element cavity 2 to communicate the indicating element cavity 2 with the retracting unit 3. The retracting unit 3 has a valve hole 11. The reel 1 has a filling hole 12 formed at an inner portion of the reel 1 at a position close to the retracting unit 3, wherein the filling hole 12 is communicating with the operation cavity 14.

Before using the line marker of the present invention, the retracting unit 3 is in a concealed state, wherein the sealing member 6 is placed at the indicating element cavity 2 which is filled with the indicating element. Then, the reel cover 7 is mounted to the housing to press on the sealing member 6. In order to use the line marker of the present invention, the indicating element cavity 2 is directly filled with the indicating element, wherein the sealing member 6 will self-adjust the interior pressure of the indicating element cavity 2 until the interior pressure in balance manner with respect to the exterior pressure via the pressuring relief valve 13, so as to prevent the leakage of the indicating element.

When the mark liner is in use, the retracting unit is in opened state such that the indicating element in the indicating element cavity 2 passes through the communicating hole 15, the valve hole 11, and the filling hole 12 to the operation cavity 14 such that the absorbing receptor 4 absorbs the indicating element to apply the indicating element along the operating portion of the operating cable 9 when the operating cable 9 is pulled out from the housing. Therefore, the indicating element is applied on the operating cable 9 at a saturated state so as to fulfill the role of marking a line.

The indicating element container 10 further comprises a foaming element 5 disposed in the operating cavity 14 at a position close to the opening of the housing to contact with the operating portion of the operating cable 9 when the operating cable 9 is pulled out from the housing. The purpose of having the foaming element 5 is to control the amount of indicating element which is applied on the operating cable 9, so as to ensure the operating cable 9 having enough indicating element to mark a line and to prevent excessive indicating element applied on the operating cable 9.

Accordingly, when the temperature of the environment becomes exceptionally high, the interior pressure of the indicating element cavity 2 will become higher that the indicating element cavity 102 may start to expand from the heat. Therefore, the sealing member 6 will be forced to protrude toward the exterior. The interior and exterior pressure can be balanced through releasing the interior pressure via the pressuring relief valve 13 at the reel cover 7 so as to prevent the leakage of the indicating element.

In addition, the retracting unit 3 can also save the use of indicating element efficiently. For example, for the first thirty times of pulling out the operating cable 9, the indicating element container 10 will supply the indicating element to coat along the operating cable 9. After that, once the indicating element is applied along the operating cable 9, the indicating element container 10 and the retracting unit 3 of the preferred embodiment will supply the indicating element at the same time such that the line marker of the present invention can save the indicating element efficiently and can reduce the manufacture cost.

Referring to FIGS. 5 to 8 of the drawings, a line marker according to second embodiment of the present invention illustrates an alternative mode of the first embodiment.

The line marker comprises a housing 3' having a receiving cavity and an opening communicating with the receiving cavity, a retracting unit supported within the receiving cavity of the housing 3', an operating cable having an inner coupling end coupling with the retracting unit and an outer control end extending out of the receiving cavity through the opening. A reel 6', having a coil spring mounted therein, is mounted within the housing 3' to couple with the retracting unit 3', wherein the coupling end of the operating cable 9' is coupled with the reel 6'. Therefore, when the reel 6' is driven to rotate in a clockwise direction, the coil spring restores a spring force thereat, and when the reel 6' is driven to rotate in a counterclockwise direction, the coil spring release the spring force to the reel 6'. Accordingly, by actuating the retracting unit, the operating cable is retracted into the housing 3' and is wound around the reel 6' in a coil manner. The line marker further comprises an indicating element contained in the receiving cavity of the housing 3' at a position that when an operating portion of the operating cable is pulled out from the receiving cavity through the opening, the indicating element is applied along the operating portion of the operating cable for marking a straight line on a surface. An indicating element container, which is replaceably supported in the housing 3', comprises an absorbing element is disposed in the indicating element container to absorb the indicating element, wherein the operating portion of the operating cable is contacted with the absorbing element to apply the indicating element along the operating portion of the operating cable. Accordingly, the retracting unit normally retracts the operating cable in the receiving cavity in a coil manner. The retracting unit comprises a driving wheel 5' coaxially mounted to the reel 6' and an actuating wheel 1', having a hand-reel 2', which is rotatably mounted at the housing 3' and is coaxially coupling with the driving wheel 5', such that when the hand-reel 2' is manually actuated to drive the actuating wheel 1' to rotate, the reel 6' is driven to rotate through the driving wheel 5' to retract the operating cable around the reel 6'. The retracting unit further comprises a wheel locker 4' supported in the housing 3' to lock up the actuating wheel 1' in a rotatably movable manner. The line marker further comprises a pin assembly 11' coupling with the housing 3' at the opening thereof via a detachable connector 9', 10', wherein the detachable connector 9', 10', which are made of durable material to reduce the friction applying to the housing 3', are used for slidably mounting the pint assembly 11' at the opening of the housing 3' to detachably mount to the control end of the operating cable. The pin assembly 11' comprises a pin sleeve 12', a pin 13' slidably received in the pin sleeve 12', and a compression spring 14' received in the pin sleeve 12' for applying an urging force against the pin 13'. The pin assembly 11' further comprises a pin actuator 15' pivotally mounted to the pin sleeve 12' via a rivet 16' for operating the pin 13' sliding at the pin sleeve 12'. The line marker further comprises an indicating element container 7' containing the indicating element, wherein the indicating element container 7' is replaceably received in the housing 3'. A receptor 8' is movably mounted at a sidewall of the housing 3' to press against the indicating element container 7' through a slot for releasing the indicating element therefrom, wherein the receptor 8' having a pusher button at the sidewall of the housing 3' and a pressing head sealedly extended into the indicating element container 7' to press against the absorbing element. The receptor 8' is made of two different materials which allow the pressing head sealedly extended to the indicating element container 7' through a slot formed on the indicating element container 7' and allow a pressing movement of the pressing head so as to improve the amount of indicating element applying along the operating cable.

In order to use the line marker of the present invention, the pin assembly 11' is firstly pulled out from the housing 3' to pull a head of the pin 13' out of the pin sleeve 12' such that the pin 13' is coupling with the control end of the operating cable. Then, the user is able to press at the receptor 8' to release the indicating element in the indicating element container 7' so as to apply the indicating element along the operating cable. After the line has been marked on the surface, the pin assembly 11' is detached from the operating cable. Therefore, the operating cable can be either automatically retracted to wind up around the reel 6' via the coil spring or manually retracted around the reel 6' by actuating the hand-reel 2' of the retracting unit.

Referring to FIGS. 9 to 13 of the drawings, an indicating element container of a line marker according to third embodiment of the present invention illustrates an alternative mode of the second embodiment. Accordingly, the indicating element container is replaceably received in the housing of the line marker such that when the indicating element is used up, the user is able to replace a new indicating element container without refilling the indicating element therein.

The indicating element container comprises four sidewalls, a bottom wall, and a top wall to form a cavity for containing the indicating element therein. The indicating element container further comprises an absorbing element 1", such as a sponge, disposed in the cavity for absorbing the indicating element so as to retain the indicating element in the indicating element container. The indicating element container has two protruding portions outwardly extended at upper sides of two opposing sidewalls respectively, two U-shaped slots 2" indently formed at the two protruding portions respectively, a vent hole 4" formed on the top wall of the indicating element container, and two elongated guiding grooves 5" which are indently formed on the top wall and are communicatively extended from the vent hole 4" towards the two U-shaped slots 2", and two cornering slots 3" extended from the guiding grooves 5" to align with the U-shaped slots 2". Accordingly, the vent hole 4" is formed at a center of the top wall. It is worth to mention that the U-shaped slots 2", the guiding grooves 5", the cornering slots 3" and the vent hole 4" are alignedly positioned to form a straight cable channel to slidably receive the operating cable. In other words, when the operating cable is slid along the cable channel, the operating cable contacts with the absorbing element 1" to apply the indicating element along the operating cable. It is worth to mention that the indicating element container can be used for the line marker of the second embodiment that the receptor 8' is pressed to the absorbing element 1" for releasing the indicating element. In addition, the vent hole 4" can have a circular shape or a non-circular shape, such as oval or quadrangle. When the indicating element is unevenly absorbed by the absorbing element 1", the user is able to use an elongated tool, having a corresponding shape, to press on the absorbing element 1" through the vent hole 4" to allow the indicating element is evenly spread within the absorbing element 1".

The indicating element container further comprises a sealing member 6" detachably sealed at the top wall to seal the cable channel (i.e. the U-shaped slots 2", the guiding grooves 5", the cornering slots 3" and the vent hole 4"). In addition, a stopper wheel 8" is slidably mounted at one of the U-shaped slots 2" of the cable channel and is arranged when the indicating element container is not in use, the stopper wheel 8" is pushed to lock the operating cable at the respective U-shaped slot 2" so as to prevent the leakage of the indicating element within the indicating element container, especially preventing the evaporation of the indicating element.

Referring to FIGS. 14 to 19, a line marker according to a third embodiment of the present invention illustrates another alternative mode of the above first and second embodiments.

The line marker comprises a housing 1A having a receiving cavity and an opening communicating with the receiving cavity, a retracting unit supported within the receiving cavity of the housing 1A, an operating cable having an inner coupling end coupling with the retracting unit and an outer control end extending out of the receiving cavity through the opening. A reel 5A is mounted within the housing to couple with the retracting unit, wherein the coupling end of the operating cable is coupled with the reel 5A such that when the reel 5A is driven to rotate by the retracting unit, the operating cable is retracted into the housing 1A and is wound around the reel 5A in a coil manner. Accordingly, the retracting unit normally retracts the operating cable in the receiving cavity in a coil manner. The line marker further comprises an indicating element contained in the receiving cavity at a position that when an operating portion of the operating cable is pulled out from the receiving cavity through the opening, the indicating element is applied along the operating portion of the operating cable for marking a straight line on a surface. Accordingly, the housing further comprises a reel cover 7A detachably mounted to the housing to cover the reel 1A.

The line marker further comprises a power retracting device for automatically retracting the operating cable back to the reel 5A, wherein the power retracting device comprises a rechargeable battery 19A such as lithium battery, and a motor 16A, having an output axle, supported within the housing 1A, a gear unit 3A coupling at the output axle of the motor 16A to engage with the reel 5A. The power retracting device further comprises a motor controller 51A electrically coupling between the rechargeable battery 19A and the motor 16A, and a switch 17A electrically coupling between the motor controller 51 and a capacitor 53A. A circuit tester 52A is coupling between the motor controller 51A and the capacitor 53A. The motor controller 51A is also electrically coupling with the motor 16A. Accordingly, the motor 16A has a power less than 1000 rpm to retract the operating cable without breaking the operating cable. Accordingly, a coaxial shaft 4A is extended from a center of the reel 5A to engage with the gear unit 3A such that when the output axle of the motor 16A is driven to rotate, the reel 5A can be correspondingly rotate to smoothly retract the operating cable. Accordingly, a sealing ring 2 and a locker 6 are used for concealing the reel 5A in the housing 1A, wherein a reel cover 7 is mounted to the housing 1A to enclose the reel 5A therein. A receptor 8A is movably mounted on the reel cover 7 for pressing the indicating element container to control the amount of indicating element applying along the operating cable.

Therefore, when the power retracting device is short circuit or out of battery, the operating cable can be manually retracted via the retracting unit. According, the retracting unit comprises a hand-reel 41A, which is made of flexible material, rotatably mounted at the sidewall of the housing 1A along a guiding edge 22A to couple with the reel 5A through a window 42A such that when the hand-reel 41A is driven to rotate, the reel 5A is rotated to wind up the operating cable therearound. Accordingly, a locker 43 is engaged with the hand-reel 41A. Therefore, the line marker of the present invention allows either manual or automatic retracting operation to retract the operating cable.

Figure 16:
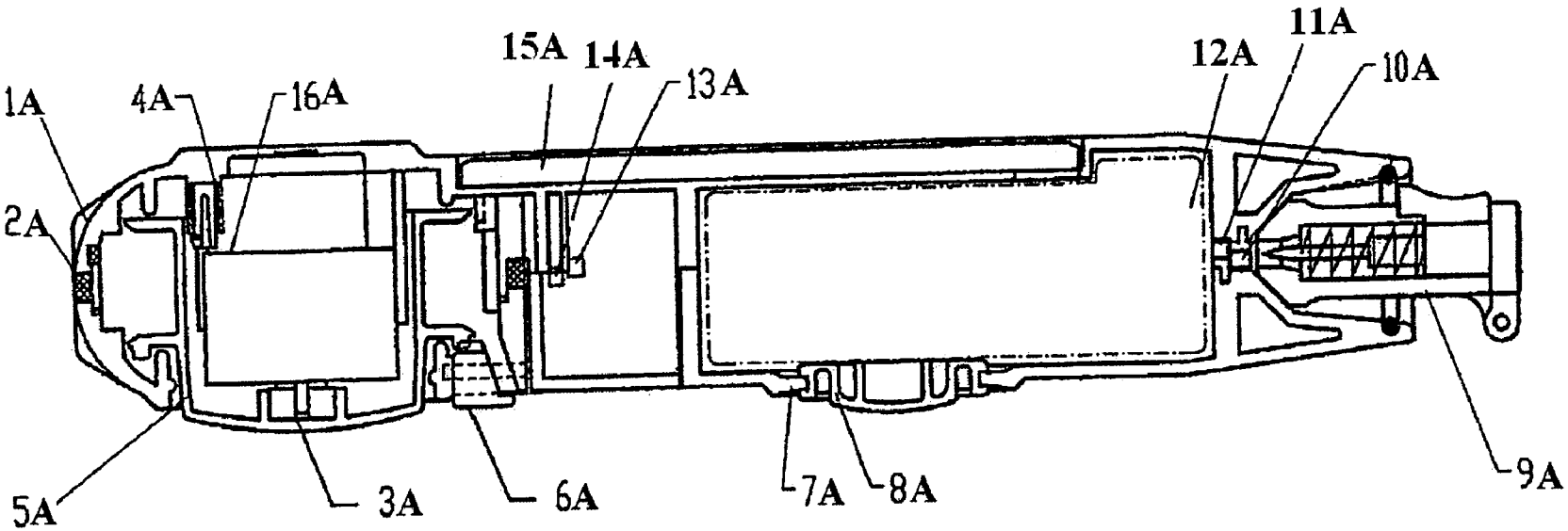
FIG. 16 is another sectional view of the line marker according to the above fourth preferred embodiment of the present invention.
Figure 17:
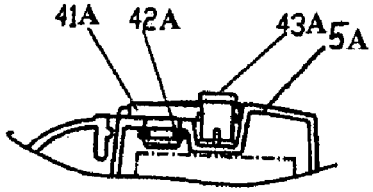
FIG. 17 is a sectional view of the manual retracting unit of line marker according to the above fourth preferred embodiment of the present invention.
Figure 18:
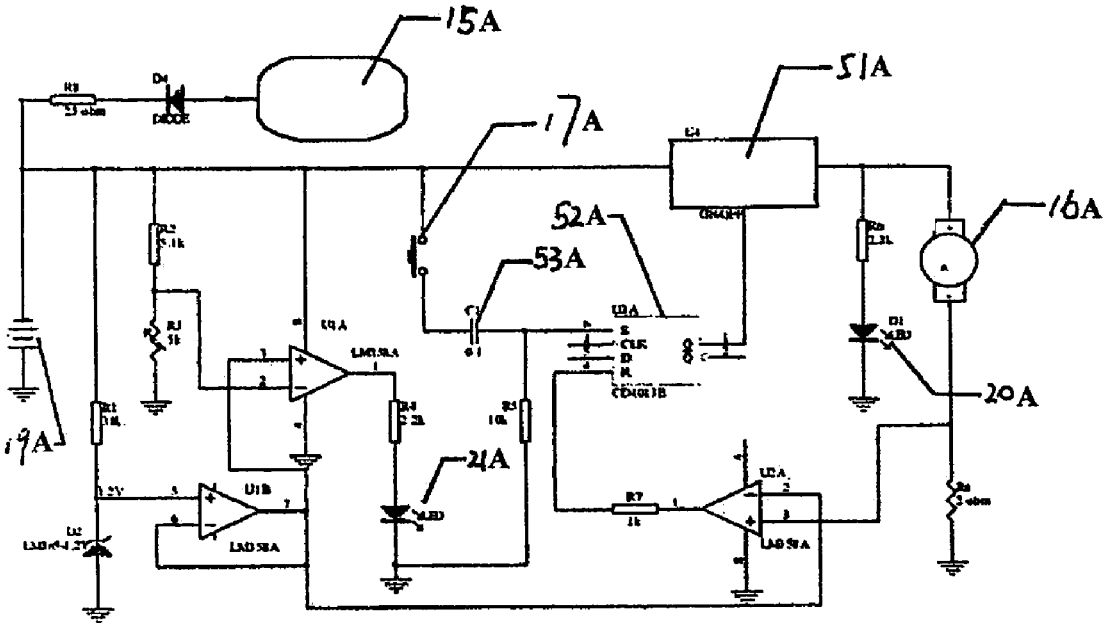
FIG. 18 is a circuit diagram of the line marker according to the above fourth preferred embodiment of the present invention.
Figure 19:
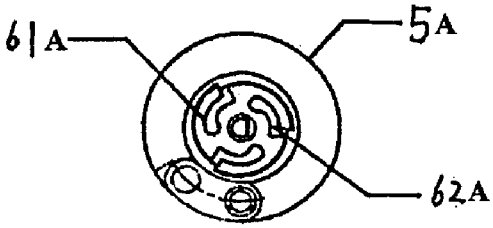
FIG. 19 illustrates the guiding element of the line marker according to the above fourth preferred embodiment of the present invention.

As shown in FIGS. 16 and 18, the line marker further comprises a solar energy collector 15A supported on the housing for collecting solar energy and converting the solar energy into electrical energy to be stored in the rechargeable battery 19A. Alternatively, a charger circuit 18A can be used to recharge the rechargeable battery 19A. When the rechargeable battery 19A is fully charged, the output voltage of the rechargeable battery 19 is 3.6V. An indicator comprises a first LED 20A and a second LED 21A for indicating the state of the rechargeable battery 19A. When the switch 17A is on to actuate the motor 16A, i.e. the normal working operation of the motor 16A, the first LED 20A is powered on for producing a light signal such that the reel 5A starts to rotate to retract the operating cable. When the operating cable is wound around the reel 5A or the operating cable is tangled, the circuit tester 52A will undergo a current check to generate an electric signal such that the motor controller 51A will cut the current and stop the operation of the motor 16A. Once the operating cable is untangled, the switch 17A can be actuated again to start the motor 16A until the operating cable is retracted to the reel 5A. When the power level of the rechargeable battery 19A is below a predetermined level, such as 1.2V, the circuit tester 52A will undergo the current check and the second LED 21A will generate a light signal to indicate the insufficient power of the rechargeable battery 19A. In other words, the rechargeable battery 19A must be recharged.

Figure 6:
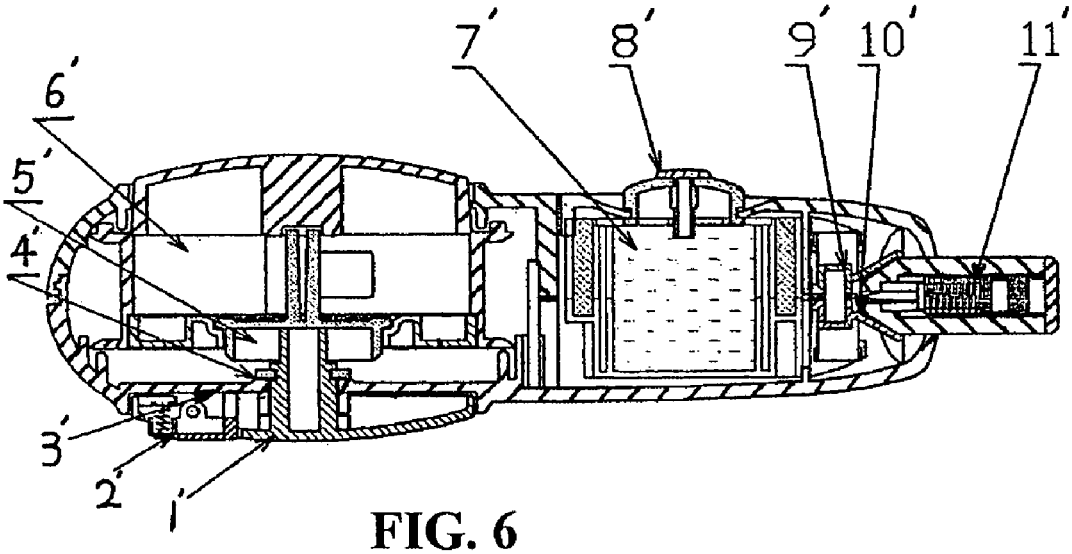
FIG. 6 is a top sectional view of the line marker according to the above second preferred embodiment of the present invention.
Figure 7:
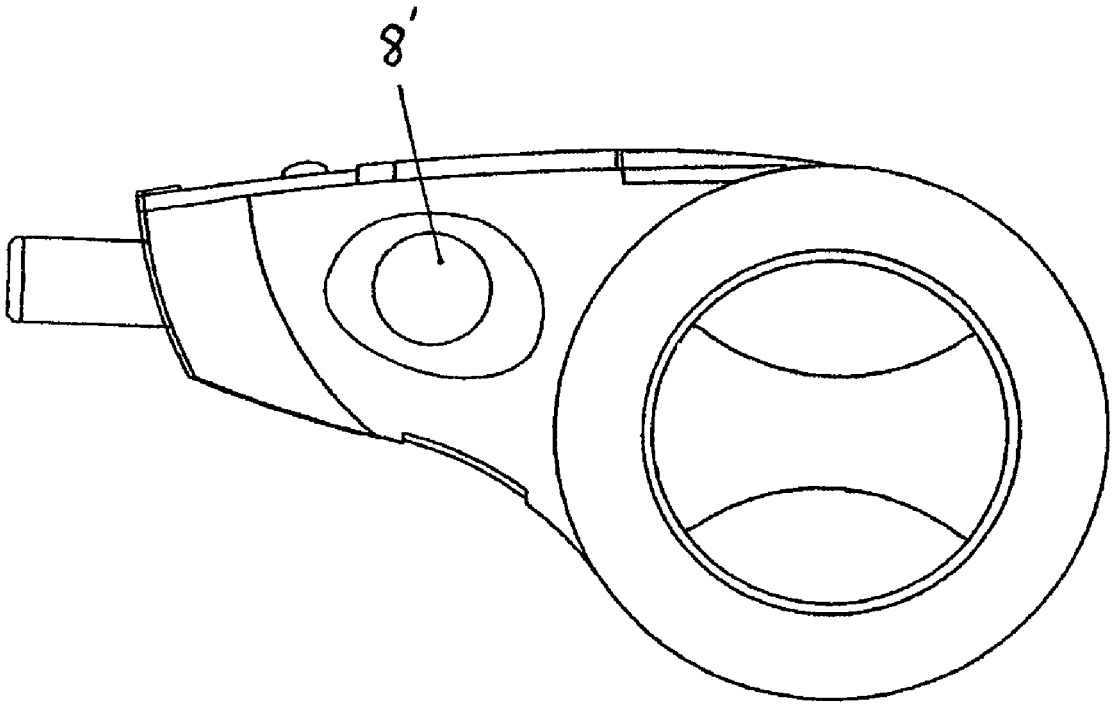
FIG. 7 is a second side view of the line marker according to the above second preferred embodiment of the present invention.
Figure 8:
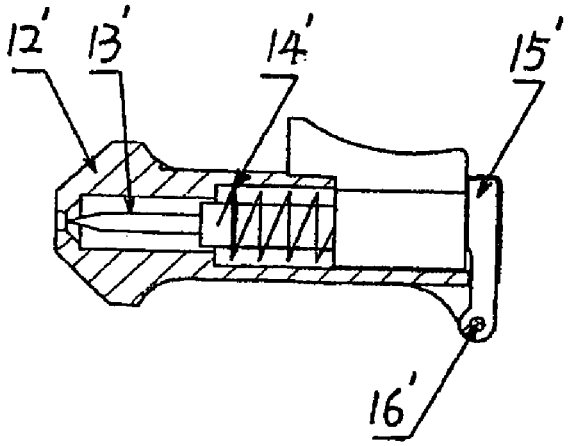
FIG. 8 is a sectional view of a pin assembly of the line marker according to the above second preferred embodiment of the present invention.
Figure 9:
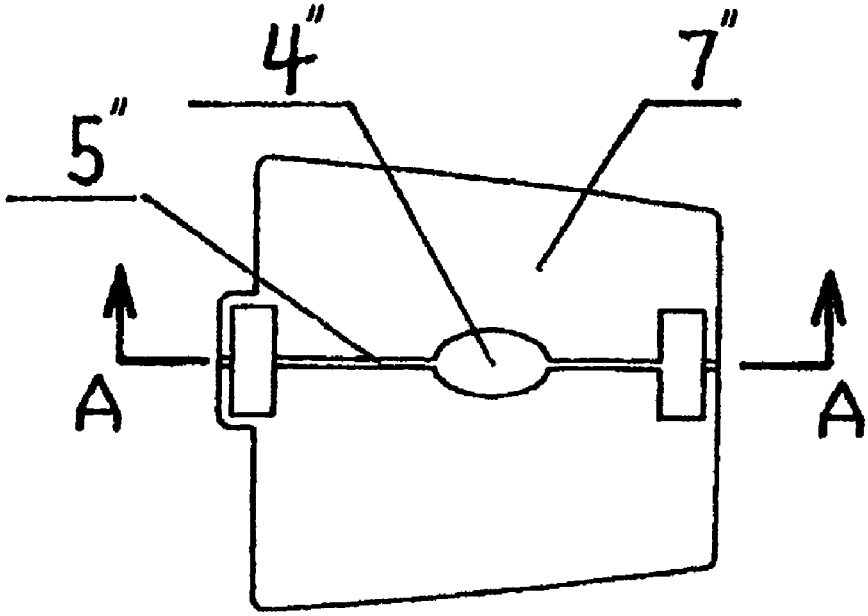
FIG. 9 is a top view of an indicating element container of a line marker according to a third preferred embodiment of the present invention.
Figure 10:
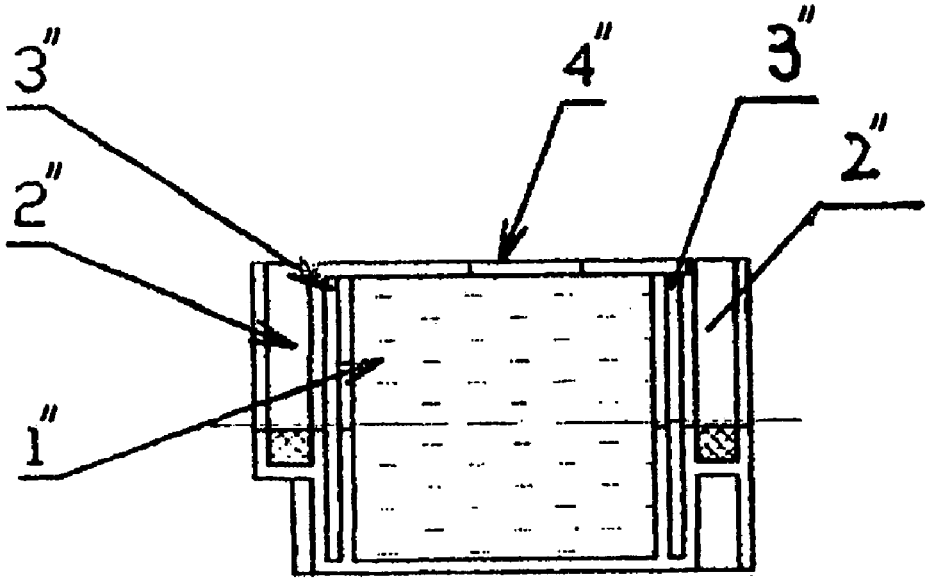
FIG. 10 is a sectional view of the indicating element container of the line marker according to the above third preferred embodiment of the present invention.
Figure 11:
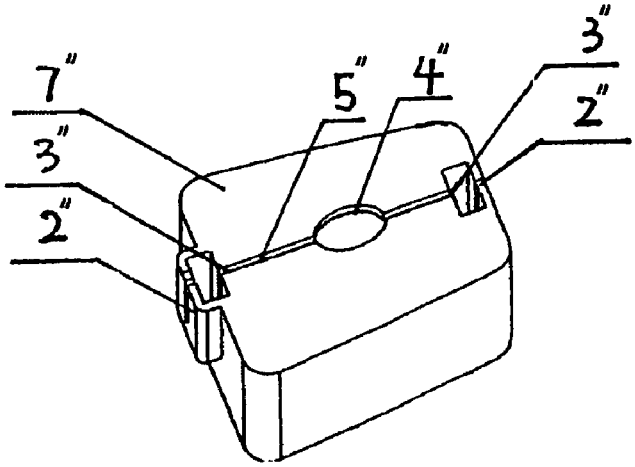
FIG. 11 is a perspective view of the indicating element container of the line marker according to the above third preferred embodiment of the present invention.
Figure 12:
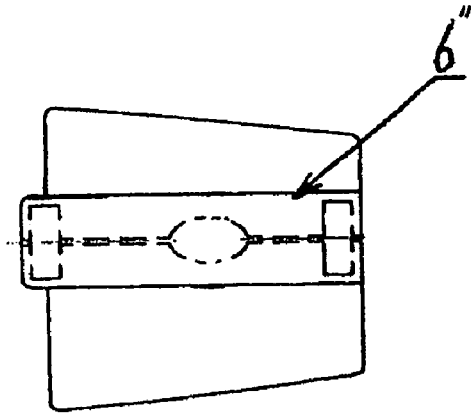
FIG. 12 is a top view of the indicating element container of the line marker according to the above third preferred embodiment of the present invention, illustrating the sealing member.
Figure 13:
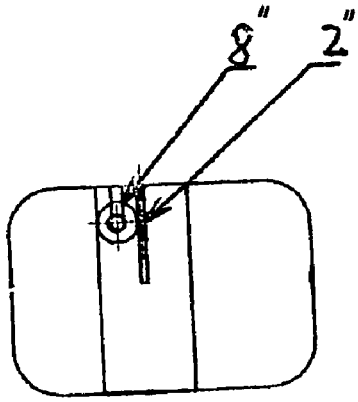
FIG. 13 is a left view of the indicating element container of the line marker according to the above third preferred embodiment of the present invention.
Figure 14:
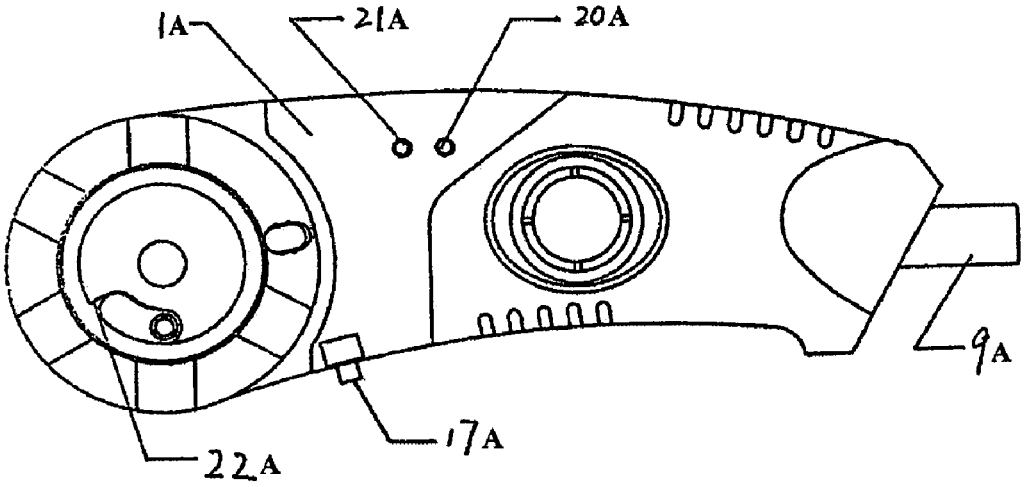
FIG. 14 is a side view of a line marker according to a fourth preferred embodiment of the present invention.
Figure 15:
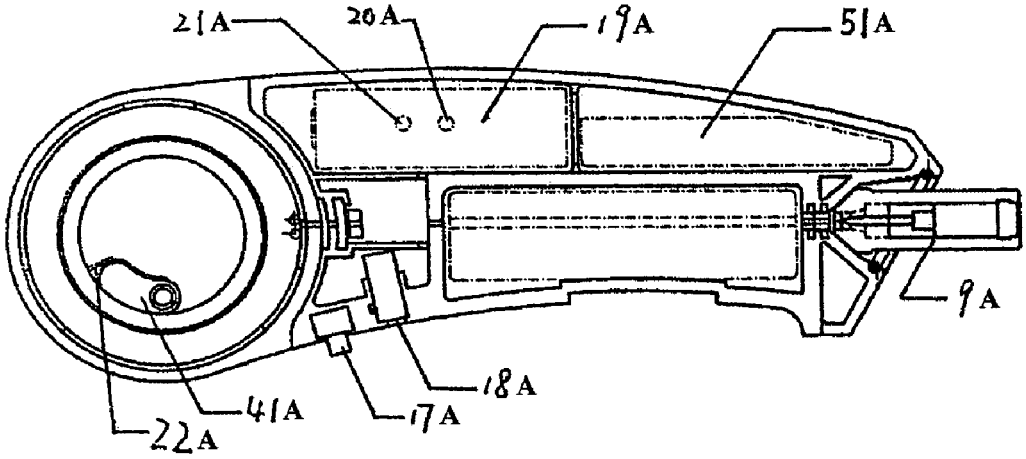
FIG. 15 is a sectional view of the line marker according to the above fourth preferred embodiment of the present invention.

As shown in FIG. 6, the line marker further comprises a guiding element 61A rotatably mounted at a guiding slot 62A of the reel 5A, wherein the guiding element 61A is adapted to turn when the output axle of the motor 16A is driven to rotate in a clockwise direction to retract the operation cable. Otherwise, the guiding element 61A cannot be rotate when the output axle of the motor 16A is driven to rotate in a counterclockwise direction.

A pin assembly 9A comprises pin rotors 10A, 11A, 13A, 14A spacedly supporting in the housing 1A to engage with the operating cable, wherein the pin rotors 10A, 11A, 13A, 14A are made of durable material to reduce the friction of operating cable being pulled.

Figure 20:
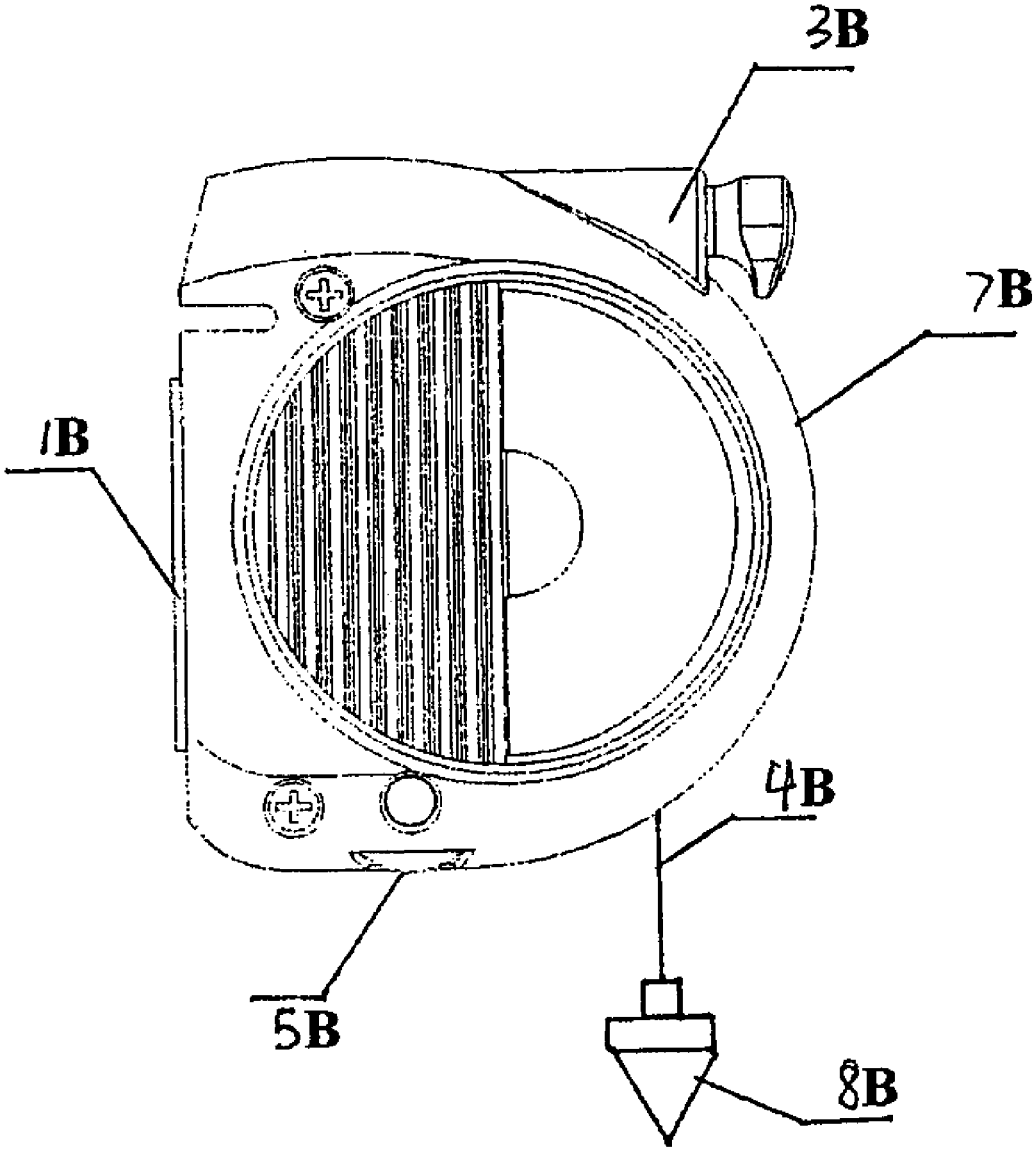
FIG. 20 is a side view of the line marker according to a fifth preferred embodiment of the present invention.
Figure 21:
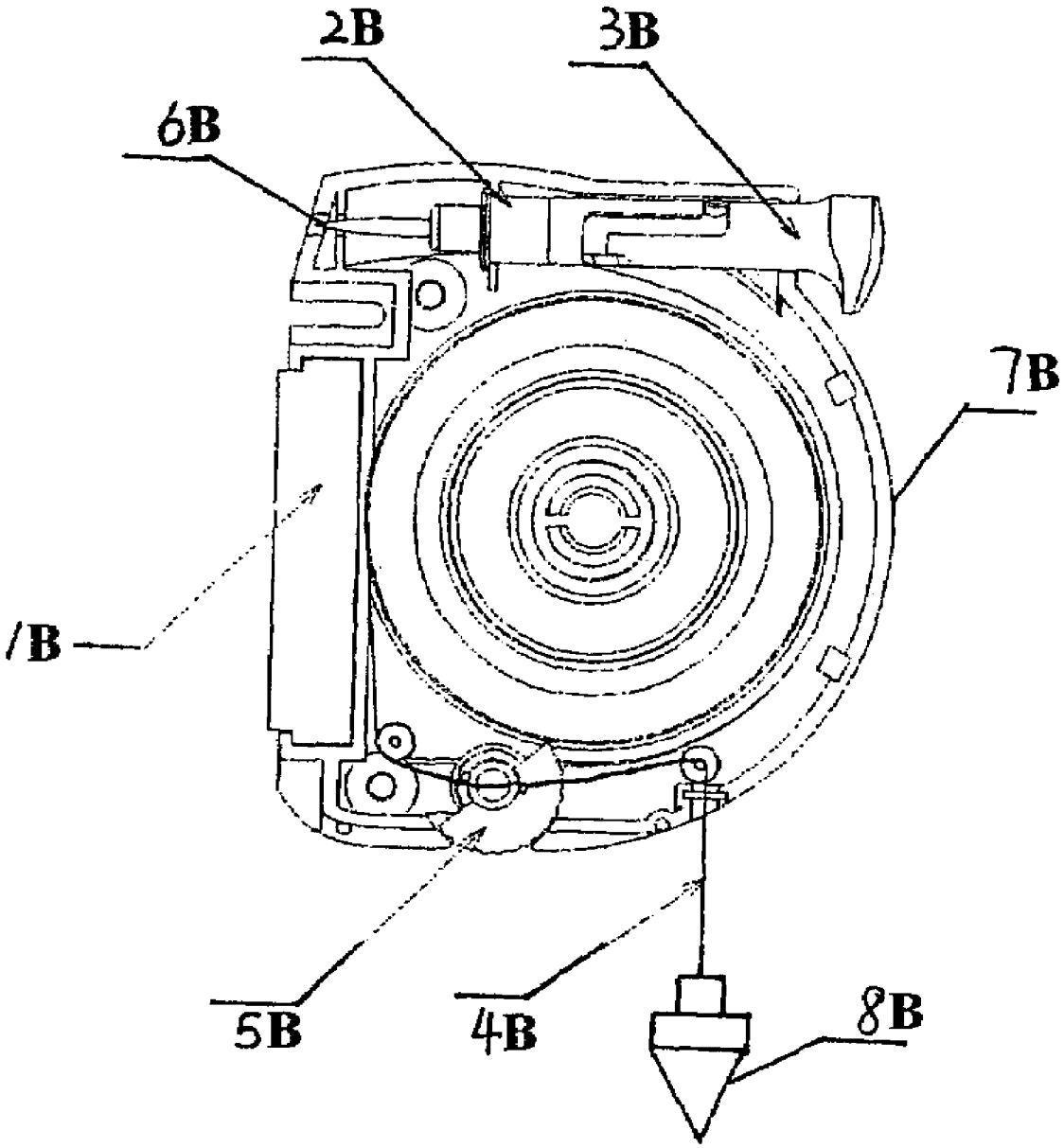
FIG. 21 is a sectional view of line marker according to the above fifth preferred embodiment of the present invention.

Referring to FIGS. 20 and 21 of the drawings, a line marker according to fifth embodiment of the present invention illustrates an alternative mode of the first, second, third and fourth embodiments. The line marker comprises a housing having a receiving cavity and an opening communicating with the receiving cavity, a retracting unit supported within the receiving cavity of the housing, an operating cable 4B having an inner coupling end coupling with the retracting unit and an outer control end extending out of the receiving cavity through the opening. A reel 7B is mounted within the housing to couple with the retracting unit, wherein the coupling end of the operating cable 4B is coupled with the reel 7B such that when the reel 7B is driven to rotate by the retracting unit, the operating cable 4B is retracted into the housing and is wound around the reel 7B in a coil manner. Accordingly, the retracting unit, which comprises a coil spring, normally retracts the operating cable 4B in the receiving cavity in a coil manner. The line marker further comprises an indicating element contained in the receiving cavity at a position that when an operating portion of the operating cable 4B is pulled out from the receiving cavity through the opening, the indicating element is applied along the operating portion of the operating cable 4B for marking a straight line on a surface.

The line marker further comprises a position stabilizer 1B, a weight element 8B, and a retractable pin assembly. The retractable pin assembly has a pin cavity formed within the receiving cavity of the housing at a position adjacent to the reel 7B, a pin 2B having a pinhead 6B slidably received in the pin cavity, and a pin pusher 3B which is slidably mounted at the pin cavity and is extended from the pin 2B, wherein when the pin pusher 3B is pressed, the pinhead 6B of the pin 2B is slid out of the pin cavity of the housing. In other words, the pin 2B is adapted to be retracted into the housing when it is not in use. Accordingly, the pin pusher 3B has a guiding groove slidably engaging with a guiding protrusion extended from the inner wall of the pin cavity to guide the sliding movement of the pin 2B. It is worth to mention that the guiding groove has a first stopper end and an opposed second stopper end arranged when the pin pusher 3B is slidably pressed until the guiding protrusion engages with the first stopper end of the guiding groove, the pinhead 6B is extended out of the housing. When the pin pusher 3B is slid to receive the pinhead 6B back into the housing, the guiding protrusion engages with the second stopper end of the guiding groove. It is worth to mention that when the pin pusher 3B is turned at a position that the guiding protrusion engages with the first stopper end of the guiding groove, the pin 2B is locked to retain the pinhead 6B out of the housing. When the pin pusher 3B is turned at a position that the guiding protrusion engages with the second stopper end of the guiding groove, the pin 2B is locked to retain the pinhead 6B within the housing. In other words, the pin pusher 3B not only slides along the pin cavity to push the pinhead 6B out of the housing but also rotates within the pin cavity to lock up the pin 2B in position. The pin assembly further comprises a compression spring coaxially mounted to the pin 2B within the pin cavity for applying an urging force against the pin 2B to push the pinhead 6B back to the housing.

The weight element 8B is coupling with the outer control end of the operating cable 4B. An adjustor 5B is mounted at the outer side of the reel 7B to expose the adjustor 7B outside, wherein the adjustor 5B has a frictional edge for enhancing the frictional force against the operating cable 4B so as to selective adjust the weight element 8B. The position stabilizer 1B comprises a magnetic member attached to a bottom side of the housing wherein the position stabilizer B is adapted for magnetically mounting on a surface having a magnetic attracting ability, such as metal surface, so as to retain the line marker in position.

In order to use the line marker, the pinhead 6B is pushed out of the housing and is penetrated on the surface to retain the line marker in position. Then, the operating cable with the indicating element therealong can be pulled out from the housing. It is worth to mention that the line marker is adapted to mark a vertical straight when the line marker is mounted on a wall via the pinhead 6B and the weight element 8B ensures the operating cable 4B to mark a vertical straight line with respect to the wall.

According to first to fifth embodiments of the present invention, all distinctive features thereof can be incorporate with each other. For example, the line marker with replaceable indicating element container can be incorporate with automatic retracting unit to provide both replaceable feature and automatic retracting feature.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A line marker, comprising:

a housing having a receiving cavity and an opening communicating with said receiving cavity;

a retracting unit supported within said receiving cavity of said housing;

a reel coupling with said retracting unit and rotatably supported within said receiving cavity of said housing; an operating cable having an inner coupling end coupling with said reel and an outer control end extending out of said receiving cavity through said opening, wherein said retracting unit normally retracts said operating cable in said receiving cavity around said reel in a coil manner;

an indicating element contained in said receiving cavity at a position that when an operating portion of said operating cable is pulled out from said receiving cavity through said opening, said indicating element is applied along said operating portion of said operating cable for marking a straight line on a surface; and an indicating element container which contains said indicating element therein and is received in said retracting unit, wherein said housing further has an operating cavity communicating with said indicating element container to allow said indicating element passing to said operating cavity, wherein said indicating element container comprises an absorbing receptor disposed in said operating cavity to absorb said indicating element and to contact with said operating cable, such that when said operating cable is pulled out from said housing, said absorbing receptor applies said indicating element along said operating cable.

2. The line marker, as recited in claim 1, wherein said indicating element container further comprises a sealing member sealing thereon to control a flow of said indicating element towards said operating cavity, wherein said indicating element is forced to flow towards said operating cavity when an exterior pressure of said indicating element container is larger than an interior pressure thereof.

3. The line marker, as recited in claim 2, further comprising a foaming element disposed in said operating cavity at a position close to said opening of said housing to contact with said operating portion of said operating cable when said operating cable is pulled out from said housing, wherein said foaming element is adapted for controlling an amount of said indicating element applied along said operating cable and ensuring said operating cable having enough said indicating element applied thereon, so as to prevent excessive indicating element applied along said operating cable.

4. The line marker, as recited in claim 3, wherein said indicating element is liquid ink absorbed by said absorbing receptor to apply along said operating cable.

5. A line marker, comprising:

a housing having a receiving cavity and an opening communicating with said receiving cavity;

a retracting unit supported within said receiving cavity of said housing;

a reel coupling with said retracting unit and rotatably supported within said receiving cavity of said housing; an operating cable having an inner coupling end coupling with said reel and an outer control end extending out of said receiving cavity through said opening, wherein said retracting unit normally retracts said operating cable in said receiving cavity around said reel in a coil manner;

an indicating element contained in said receiving cavity at a position that when an operating portion of said operating cable is pulled out from said receiving cavity through said opening, said indicating element is applied along said operating portion of said operating cable for marking a straight line on a surface; and an indicating element container replaceably supported in said housing, wherein said indicating element container comprises an absorbing element disposed therein to absorb said indicating element, wherein said operating portion of said operating cable contacts with said absorbing element to evenly apply said indicating element along said operating cable when said operating cable is pulled out from said housing, wherein said indicating element container has a slot formed thereon to communicate with said absorbing element, wherein said housing further comprises a receptor movably mounted at a sidewall of said housing and extended to said indicating element container through said slot such that when said receptor is pressed against said absorbing element, said indicating element container releases said indicating element to apply along said operating cable.

6. The line marker, as recited in claim 5, wherein said indicating element is liquid ink absorbed by said absorbing receptor to apply along said operating cable.

7. A line marker, comprising:

a housing having a receiving cavity and an opening communicating with said receiving cavity;

a retracting unit supported within said receiving cavity of said housing;

a reel coupling with said retracting unit and rotatably supported within said receiving cavity of said housing; an operating cable having an inner coupling end coupling with said reel and an outer control end extending out of said receiving cavity through said opening, wherein said retracting unit normally retracts said operating cable in said receiving cavity around said reel in a coil manner;

an indicating element contained in said receiving cavity at a position that when an operating portion of said operating cable is pulled out from said receiving cavity through said opening, said indicating element is applied along said operating portion of said operating cable for marking a straight line on a surface; and an indicating element container replaceably supported in said housing, wherein said indicating element container comprises an absorbing element disposed therein to absorb said indicating element, wherein said operating portion of said operating cable contacts with said absorbing element to evenly apply said indicating element along said operating cable when said operating cable is pulled out from said housing, wherein said indicating element container has a slot formed thereon to communicate with said absorbing element, wherein said housing further comprises a receptor movably mounted at a sidewall of said housing and extended to said indicating element container through said slot such that when said receptor is pressed against said absorbing element, said indicating element container releases said indicating element to apply along said operating cable, wherein said indicating element container further comprises four sidewalls, a bottom wall, and a top wall to form a cavity for said absorbing element disposed therein, wherein said indicating element container further comprises an elongated cable channel formed on said top wall, wherein said operating portion of said operating cable is slid along said cable channel to contact with said absorbing element so as to apply said indicating element along said operating portion of said operating cable when said operating cable is pulled out from said housing, wherein said indicating element container further comprises a sealing member detachably sealed on said top wall to seal said cable channel, and a stopper wheel slidably mounted at said cable channel to lock up said operating portion of said operating cable at said cable channel.

8. The line marker, as recited in claim 7, wherein said indicating element is liquid ink absorbed by said absorbing receptor to apply along said operating cable.

9. A line marker, comprising:

a housing having a receiving cavity and an opening communicating with said receiving cavity;

a retracting unit supported within said receiving cavity of said housing;

a reel coupling with said retracting unit and rotatably supported within said receiving cavity of said housing; an operating cable having an inner coupling end coupling with said reel and an outer control end extending out of said receiving cavity through said opening, wherein said retracting unit normally retracts said operating cable in said receiving cavity around said reel in a coil manner;

an indicating element contained in said receiving cavity at a position that when an operating portion of said operating cable is pulled out from said receiving cavity through said opening, said indicating element is applied along said operating portion of said operating cable for marking a straight line on a surface; and a power retracting device for automatically retracting said operating cable back to said reel, wherein said power retracting device comprises a rechargeable battery, a motor which is electrically connected to said rechargeable battery and is coupling with said reel to drive said reel to rotate, and a switch which is provided on said housing and is arranged to actuate said motor to drive said reel to rotate so as to retract said operating cable back to said reel, wherein said power retracting device further comprises a solar energy collector supported on said housing for collecting solar energy and converting said solar energy into electrical energy to be stored in said rechargeable battery, and means for current-checking of a circuit of said power retracting device, and means for generating a light signal with respect to a state of said rechargeable battery.

10. The line marker, as recited in claim 9, further comprising an indicating element container supported in said housing, wherein said indicating element container comprises an absorbing element disposed therein to absorb said indicating element, wherein said operating portion of said operating cable contacts with said absorbing element to evenly apply said indicating element along said operating cable when said operating cable is pulled out from said housing.

11. The line marker, as recited in claim 10, wherein said indicating element is liquid ink absorbed by said absorbing receptor to apply along said operating cable.

* * * * *